US008771590B2

(12) United States Patent
Valentinovich et al.

(10) Patent No.: US 8,771,590 B2
(45) Date of Patent: Jul. 8, 2014

(54) TITANIUM BASE ALLOY

(75) Inventors: Vladislav Valentinovich, Tetyukhen (RU); Igor Vasilievich Levin, Verkhnaya Salda (RU); Igor Jurievich Puzakov, Verkhnaya Salda (RU)

(73) Assignee: VSMPO-AVISMA Corporation, Salda (RU)

( * ) Notice: Subject to any disclaimer, the term of this patent is extended or adjusted under 35 U.S.C. 154(b) by 0 days.

(21) Appl. No.: 11/913,793

(22) PCT Filed: May 6, 2006

(86) PCT No.: PCT/RU2006/000234
§ 371 (c)(1),
(2), (4) Date: Nov. 7, 2007

(87) PCT Pub. No.: WO2006/123968
PCT Pub. Date: Nov. 23, 2006

(65) Prior Publication Data

US 2008/0210345 A1 Sep. 4, 2008

(30) Foreign Application Priority Data

May 16, 2005 (RU) ..... 2005114842

(51) Int. Cl.
*C22C 14/00* (2006.01)

(52) U.S. Cl.
USPC ..... 420/420; 420/418; 420/421; 148/421

(58) Field of Classification Search
USPC ..... 148/421; 420/417, 418, 420, 421
See application file for complete search history.

(56) References Cited

U.S. PATENT DOCUMENTS

| | | | | | |
|---|---|---|---|---|---|
| 3,615,378 | A | * | 10/1971 | Bomberger et al. | 148/421 |
| 4,745,977 | A | * | 5/1988 | Love et al. | 166/369 |
| 5,264,055 | A | * | 11/1993 | Champin et al. | 148/671 |
| 2003/0116233 | A1 | * | 6/2003 | Tetyukhin et al. | 148/421 |

FOREIGN PATENT DOCUMENTS

| | | | | |
|---|---|---|---|---|
| JP | 62267438 | A | * | 11/1987 |
| JP | 2004010963 | A | | 1/2004 |
| RU | 1132567 | C | | 10/1994 |
| RU | 2169782 | C1 | | 6/2001 |
| WO | 03095690 | A1 | | 11/2003 |
| WO | WO 2005123976 | A2 | * | 12/2005 |

* cited by examiner

*Primary Examiner* — Roy King
*Assistant Examiner* — Caitlin Kiechle
(74) *Attorney, Agent, or Firm* — Cesari and McKenna, LLP

(57) ABSTRACT

The invention refers to the non-ferrous metallurgy, i.e. to the creation of the modern titanium alloys, having the high genericity. Titanium-base alloy contains aluminum, vanadium, molybdenum, chromium, iron, zirconium, oxygen and nitrogen. Herewith the components of the alloy have the following ratio by weight %; aluminun—4.0-6.0; vanadium—4.5-6.0; molybdenum—4.5-6.0; chromium—2.0-3.6; iron—0.2-0.5; zirconium—0.1-less than 0.7; oxygen—0.2 max; nitrogen—0.05 max; titanium—balance. Technical result—creation of the titanium alloy with the required strength and plastic properties. The alloy may be used to produce the wide range of the products including the large-size forgings and die-forgings as well as semiproducts of small section, such as bars and plates up to 75 mm thick.

2 Claims, No Drawings

TITANIUM BASE ALLOY

FIELD OF THE INVENTION

The invention refers to the field of the non-ferrous metallurgy, i.e. to creation of the universal titanium alloys, used for manufacture of the wide range of products, including the large die-forgings and forgings as well as semiproducts of fine section, such as bars, plates up to 75 mm thick, which are widely used for manufacture of the different parts of the aeronautical engineering.

PRIOR STATE OF THE ART

The known titanium-base alloy of the following composition, weight %:

| | |
|---|---|
| Aluminum | 4.0-6.3 |
| Vanadium | 4.5-5.9 |
| Molybdenum | 4.5-5.9 |
| Chromium | 2.0-3.6 |
| Iron | 0.2-0.8 |
| Zirconium | 0.01-0.08 |
| Carbon | 0.01-0.25 |
| Oxygen | 0.03-0.25 |
| Titanium | balance |

(Patent RF #2122040, cl. C22C 14/00, 1998)

This alloy is characterized by a combination of the strength and plastic properties in large-size parts up to 150-200 mm thick, water and air-quenched. The alloy can be perfectly strained when hot and welded by any type of welding.

However, the alloy has no sufficient strength for manufacture of the large heavy parts with the thickness up to 200 mm and air-quenched.

The closest in technical substance and the result achieved to the invention pending is the titanium-base alloy containing following weight %:

| | |
|---|---|
| Aluminum | 4.0-6.0 |
| Vanadium | 4.5-6.0 |
| Molybdenum | 4.5-6.0 |
| Chromium | 2.0-3.6 |
| Iron | 0.2-0.5 |
| Zirconium | 0.7-2.0 |
| Oxygen | max 0.2 |
| Nitrogen | max 0.05 |
| Titanium | balance |

(Patent RF No 2169782, cl. C22C 14/00, issue of 2001)—prior art.

The disadvantage of the prior art is the low plasticity and tend to cracking when cold upsetting to more than 40%, which limits its use in fasteners.

DISCLOSURE OF THE INVENTION

The task to be solved by this invention is the creation of the universal titanium alloy with the required strength and plasticity characteristics, structure and producibility of the large range of products.

The technical result achieved when exercising this invention is in regulation of the optimum combination of α- and β-stabilizers in the alloy.

The specified result is achieved by the following combination in weight % of elements in titanium-base alloy, containing aluminum, vanadium, molybdenum, chromium, iron, zirconium, oxygen and nitrogen,

| | |
|---|---|
| Aluminum | 4.0-6.0 |
| Vanadium | 4.5-6.0 |
| Molybdenum | 4.5-6.0 |
| Chromium | 2.0-3.6 |
| Iron | 0.2-0.5 |
| Zirconium | 0.1-less than 0.7 |
| Oxygen | max 0.2 |
| Nitrogen | max 0.05 |
| Titanium | balance |

β-phase contributes mainly to the high strength of the alloy due to wide range of the β-stabilizers (V, Mo, Cr, Fe), their amount and effect on maintaining the metastable phase in the course of the slow cooling (for example, in the air) of die-forgings large sections. Though β-phase drives the hardening process in the alloy, the strength may be increased only due to the increased strength of the α-phase, the general fraction of which for this alloy is 60-70%. For this purpose the alloy is alloyed with the α-stabilizer zirconium. Zirconium forms a wide range of the solid solutions with α-titanium, is relatively close to it in melting temperature and density and increases the corrosion resistance. Alloying with zirconium in the range of 0.1—less than 0.7% ensures the combination of the high strength and plasticity for large forgings and die-forgings as well as semiproducts of fine section, such as bars, plates up to 75 mm thick, allows to perform the hot and cold deformation with the upset ratio up to 60%.

EMBODIMENT OF THE INVENTION

To investigate the properties of the applied alloy the trial ingots were produced with the diameter of 190 mm with the averaged chemistry (data is given in Table 1).

TABLE 1

| | Chemical Composition, wt. % | | | | | | | | |
|---|---|---|---|---|---|---|---|---|---|
| Alloy | Al | Mo | V | Cr | Zr | Fe | O | N | Ti |
| 1 | 5.45 | 5.3 | 5.35 | 3.1 | 0.65 | 0.4 | 0.145 | 0.006 | Bal |
| 2 | 5.1 | 5.22 | 5.1 | 2.9 | 0.3 | 0.41 | 0.12 | 0.005 | Bal |
| 3 | 4.9 | 4.8 | 5.0 | 2.8 | 0.5 | 0.3 | 0.10 | 0.006 | Bal |
| 4 | 5.3 | 5.3 | 5.2 | 3.1 | 0.2 | 0.4 | 0.12 | 0.006 | Bal |
| 5 Prior art | 5.1 | 4.9 | 5.3 | 3.1 | 1.2 | 0.35 | 0.12 | 0.006 | Bal |

The ingots were forged in succession in β-, α+β-, β-, α+β-fields with the final deformation in α+β-field within 45-50% for the cylindrical stock(billet) 40 mm in diameter.

The forgings were subsequently heat-treated:

a) Solution heat-treatment:

heating up to 790° C., 3 h holding, air cooling.

b) Ageing:

heating up to 560° C., 8 h holding, air cooling.

Forgings mechanical properties (averaged data in the longitudinal direction) are under Table 2.

TABLE 2

| Alloy | $\sigma_{02}$ (VTS), MPa | $\sigma_B$ (UTS), MPa | δ (A), % | Ψ (Ra), % | $K_{1C}$, MPa/$\sqrt{m}$ |
|---|---|---|---|---|---|
| 1 | 1230 | 1300 | 10 | 21 | 63 |
| 2 | 1200 | 1290 | 15 | 28 | 69 |
| 3 | 1110 | 1190 | 14 | 26 | 71 |
| 4 | 1160 | 1270 | 16 | 32 | 72 |
| 5 Prior art | 1255 | 1350 | 10.5 | 27 | 51.5 |

As the forgings mechanical test results state, microalloying with zirconium in the claimed ranges 0.1—less than 0.7 weight % in combination with quenching allows to keep the high strength, providing for the fine alloy plasticity.

COMMERCIAL PRACTICABILITY

The applied titanium alloy as compared to the known alloys may be used for manufacture of the wide range of products of the critical application, including the large-size forgings and die-forgoings as well as semiproducts of small section, such as bars, plates up to 75 mm thick, which are widely used for aerotechnical parts including fasteners.

The invention claimed is:

1. Titanium-base alloy containing aluminum, vanadium, molybdenum, chromium, iron, zirconium, oxygen and nitrogen, and differing in the following selected composition, weight %:

| | |
|---|---|
| Aluminum | 4.0-6.0 |
| Vanadium | 4.5-6.0 |
| Molybdenum | 4.5-6.0 |
| Chromium | 2.0-3.6 |
| Iron | 0.2-0.5 |
| Zirconium | 0.2-0.5 |
| Oxygen | max 0.2 |
| Nitrogen | max 0.05 |
| Titanium | bal. |

2. The alloy of claim 1 wherein the alloy has a fracture toughness of 69 MPa √m to 72 MPa √m.

* * * * *

UNITED STATES PATENT AND TRADEMARK OFFICE

CERTIFICATE OF CORRECTION

PATENT NO. : 8,771,590 B2
APPLICATION NO. : 11/913793
DATED : July 8, 2014
INVENTOR(S) : Vladislav Valentinovich Tetyukhin et al.

It is certified that error appears in the above-identified patent and that said Letters Patent is hereby corrected as shown below:

On the Title Page, the Abstract should read:

The invention refers to the non-ferrous metallurgy, i.e., to the creation of the modem titanium alloys, having the high genericity, Titanium-base alloy contains aluminum, vanadium, molybdenum, chromium, iron, zirconium, oxygen and nitrogen. Herewith the components of the alloy have the following ratio by weight %; aluminum - 4.0 - 6.0; vanadium - 4.5 - 6.0; molybdenum - 4.5 - 6.0; chromium - 2.0 - 3.6; iron - 0.2 - 0.5; zirconium - 0.1 - less than 0.7; oxygen - 0.2 max; nitrogen - 0.05 max; titanium - balance. Technical result-creation of the titanium alloy with the required strength and plastic properties. The alloy may be used to produce the wide range of the products including the large-size forgings and die-forgings as well as semiproducts of small section, such as bars and plates up to 75 mm thick.

Signed and Sealed this
Twenty-fourth Day of February, 2015

Michelle K. Lee

Michelle K. Lee
*Deputy Director of the United States Patent and Trademark Office*